US008934820B2

(12) United States Patent
Herko et al.

(10) Patent No.: US 8,934,820 B2
(45) Date of Patent: Jan. 13, 2015

(54) CAST-IN BELT TIMING PATCH

(75) Inventors: Jonathan H. Herko, Walworth, NY (US); Michael S. Roetker, Webster, NY (US); Kyle B. Tallman, Farmington, NY (US); Scott J. Griffin, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 245 days.

(21) Appl. No.: 13/590,415

(22) Filed: Aug. 21, 2012

(65) Prior Publication Data

US 2014/0057114 A1 Feb. 27, 2014

(51) Int. Cl.
*G03G 15/01* (2006.01)
*G03G 15/00* (2006.01)

(52) U.S. Cl.
USPC ..... 399/302; 399/162

(58) Field of Classification Search
USPC ..... 399/51, 162, 165, 301, 302
See application file for complete search history.

(56) References Cited

U.S. PATENT DOCUMENTS

| | | | | |
|---|---|---|---|---|
| 5,991,561 | A * | 11/1999 | Okamoto et al. | 399/66 |
| 6,137,981 | A * | 10/2000 | Janssens et al. | 399/301 |
| 6,358,347 | B1 | 3/2002 | Thornton et al. | |
| 7,209,694 | B2 * | 4/2007 | Fujita et al. | 399/302 |
| 7,308,213 | B2 * | 12/2007 | Sudo et al. | 399/51 |
| 2002/0067934 | A1 | 6/2002 | Jia et al. | |
| 2005/0286930 | A1 * | 12/2005 | Sawai et al. | 399/167 |
| 2006/0045578 | A1 | 3/2006 | Ichizawa | |
| 2007/0190444 | A1 * | 8/2007 | Kotsugai et al. | 430/108.6 |
| 2009/0008025 | A1 * | 1/2009 | Mol | 156/137 |
| 2009/0324304 | A1 | 12/2009 | DeHollander et al. | |
| 2010/0189475 | A1 | 7/2010 | Atwood et al. | |
| 2010/0232819 | A1 * | 9/2010 | Kudo et al. | 399/66 |

* cited by examiner

*Primary Examiner* — Walter L Lindsay, Jr.
*Assistant Examiner* — Rodney Bonnette
(74) *Attorney, Agent, or Firm* — Fay Sharpe LLP

(57) ABSTRACT

A cast-in reflective timing patch for a belt such as an intermediate transfer belt of a printing device. The timing patch is formed during manufacturing of the belt. As such, the presence, quality, location, and alignment of the timing patch is fixed and inspection and monitoring of the timing patch is no longer required.

9 Claims, 3 Drawing Sheets

FIG. 3

CAST-IN BELT TIMING PATCH

BACKGROUND

This invention relates to electrostatographic printing machines, and more particularly to an electrostatographic printing machine wherein toner images deposited on an intermediate belt are transferred to a transfuse belt used for simultaneously transferring and fusing toner images to various substrate media such as plain paper.

Electrostatographic printers are known in which a single color toner image is electrostatically formed on a charge retentive member such as a photoreceptor drum or belt. The toner image is directly transferred to a receiving substrate, typically paper or other suitable print receiving material. The toner image is subsequently fused or affixed to the substrate, usually by the simultaneous application of heat and pressure.

In other electrostatographic color printers, a plurality of toner imaging systems each including a charge retentive member are used to create multiple color toner images on a single image receiving member. The color toner images are electrostatically transferred from the charge retentive members to an intermediate transfer member to form a composite toner image on the intermediate transfer member. The intermediate transfer member could be an Intermediate Transfer Belt (ITB) or an intermediate transfer drum. The composite toner image is electrostatically transferred to the final substrate.

Alternatively, in another prior art printer, a toner image is formed on a photoreceptor. The toner image is transferred to a single intermediate transfer member usually referred to as a transfuse member. The transfuse member generally simultaneously transfers and fuses the toner image to a substrate. The use of a single transfer member in a transfuse system can result in high transfer efficiency of background toner on the photoreceptor to the substrate due to high adhesion between the toner and typical materials used for the transfuse member, such as silicone materials. In addition, oil oligomer is generally present or else added onto silicone or other materials used for transfuse members to assist toner release to paper under the high temperature conditions used for eventual transfer and fix of the image from the transfuse member to the final receiver substrate. The photoreceptor can be contaminated by heat and oil on the transfuse member via the transfer nip.

Regardless of the type of printer, the position and speed of the various belts, such as the ITB belts, is monitored to ensure optimal operation. Manufacturers most commonly use extrinsically applied reflective timing stickers to monitor belt timing for motion quality. In some instances, multiple stickers or even punch holes are used. Timing detectors sense the movement of the intermediate belt by detecting the timing sticker or punch hole, and communicate with machine logic circuits to synchronize the various operations so that the proper sequence of events occurs in the printing process. In either case, at least one additional manufacturing step is required to be performed to add the timing feature to the belt.

BRIEF DESCRIPTION

The present disclosure sets forth a cast-in reflective timing patch in place of an extrinsically applied timing sticker or punched timing hole of the prior art. Prior art approaches require additional steps in the manufacturing process which often lead to reductions in yield, require setup and additional maintenance, and\or require additional consumable. The present disclosure eliminates all of those steps, costs, and yield hits by incorporating the timing patch into the casting substrate so that the timing patch is formed during the molding process. As such, the presence, quality, location, and alignment of the timing patch is fixed, and inspection and monitoring of the timing patch is no longer required. The cast-in patch of the present disclosure requires no maintenance or consumables aside from the modifications made to the casting drum to initially produce it.

In accordance with one aspect, an intermediate transfer belt onto which a toner image formed on a photosensitive body of an image-forming device is transferred comprises a cast-in belt timing patch, wherein the cast-in belt timing patch includes a surface of the intermediate transfer belt having a relatively high reflectance at least partially surrounded by a surface of the intermediate transfer belt having a relatively low reflectance.

The surface of the intermediate transfer belt having a relatively high reflectance can include a gloss finish. The surface of the intermediate transfer belt having a relatively low reflectance can include a matte finish. The belt can be composed of a cast material, and the cast-in timing patch can be formed integrally with and comprised of the cast material. The belt can be composed of an extruded material, and the cast-in timing patch can be formed integrally with and comprised of the extruded material. The belt can be composed of a molded material, and the cast-in timing patch can be formed integrally with and comprised of the molded material. The cast-in belt timing patch can extend across an axial width of the belt perpendicular to a direction of rotation of the belt. The cast-in belt timing patch can extend between transverse edges of the belt.

In accordance with another aspect, a method of making an intermediate transfer belt comprising the steps of providing a casting drum having an abraded surface and a smooth surface corresponding to a cast-in timing patch location, and casting the intermediate transfer belt using the casting drum, whereby the intermediate transfer belt has a matte finish except in the location of the cast-in timing patch.

The providing a casting drum can include providing a mirror casting drum, masking a portion of the casting drum corresponding to the cast-in timing patch location, and abrading an unmasked surface of the casting drum. The abrading can include mechanical abrading. The mechanical abrading can include honing.

DETAILED DESCRIPTION

Figure 1:
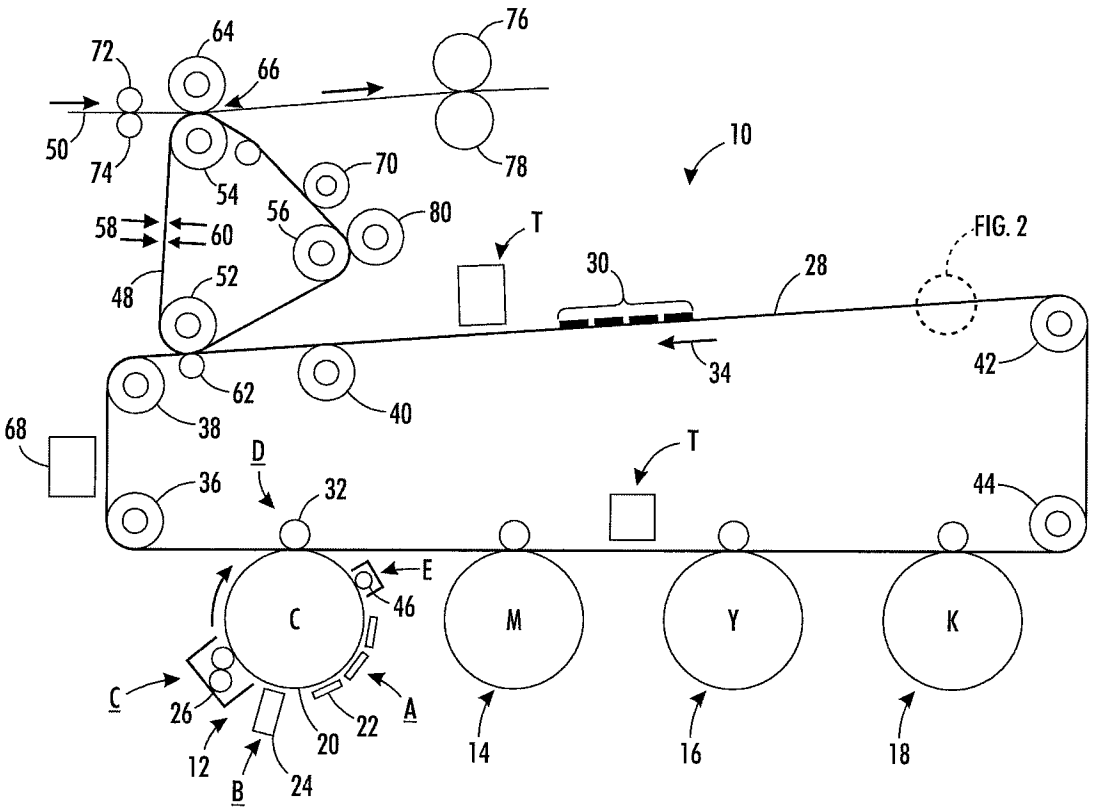
FIG. 1 is a schematic view of a print engine including a transfer belt.

With reference to FIG. 1, an exemplary color printer 10 including a belt in accordance with the present disclosure utilizes a plurality of xerographic imaging stations 12, 14, 16 and 18. Each station includes a charge retentive surface such as a photoreceptor drum 20, preferably comprising an Active Matrix (AMAT) construction. Each drum is supported in a conventional manner for rotation in an endless path such that each portion thereof moves past or through a charging station A, exposure station B, development station C, image transfer station D and cleaning station E.

As portions of each drum move past a charging device, such as an Aquatron or Di-scorotrons 22 or the like positioned at the charging station A, they are provided with a uniform electrostatic charge. An Aquatron is a liquid charging device that is an ozone-free contact charging technique based on the electrification of a water contact to the photoreceptor surface. Its advantage over other contact charging techniques is that it provides excellent charging uniformity over a wide range of process speeds, e.g. to 50 ips, using a DC-only voltage. Furthermore, it is nearly 100% efficient, operating at near theoretical voltage and current levels.

After the drum is uniformly charged it is exposed to a laser based output scanning device 24 operatively supported adjacent the drum at the exposure station B. At exposure B the scanning device 24 illuminates a uniformly charged area of the drum with a light corresponding to a first separation color of an image being reproduced thereby selectively discharging the drum to form a first latent electrostatic image which is developed at the first imaging 12 station with cyan toner. Such development is effected using a suitable developer structure 26. In like manner Magenta, Yellow and black images are formed at the imaging stations 14, 16 and 18, respectively.

The cyan, magenta, yellow and black images are sequentially transferred to an Intermediate Transfer Belt (ITB) 28 to form composite color images 30 on the ITB, the cyan image being transferred thereto at the transfer station D. Image is transferred electrostatically using an electrically biased transfer roller 32. The ITB is supported for endless movement, in the direction of the arrow 34, about a plurality of rollers 36, 38, 40, 42 and 44. A conventional belt drive mechanism, not shown, is operatively connected to one of the rollers, say roller 36, for imparting motion to the ITB. Timing detectors T sense the movement of the intermediate belt 28 and communicate with machine logic circuits (not shown) to synchronize the various operations so that the proper sequence of events occurs in the printing process. Not every image created utilizes all four of the colors provided. Thus, controls, not shown, are provided for selective operation of the imaging stations.

Residual toner particles as well as debris are removed from the charge retentive drums at each imaging station using a suitable xerographic cleaning device such as an electrostatically biased roll structure 46. Other suitable cleaning structures comprise one or more cleaning blades, not shown.

The composite images 30 are transferred to a transfuse belt 48. A transfuse belt is one that simultaneously transfers and fuses toner images to a substrate such as a sheet of plain paper 50. The transfuse belt is supported for movement in a clockwise endless path by a plurality of support rollers 52, 54 and 56. Transfuse belt movement is controlled using a drive mechanism, not shown, that may be operatively coupled to one of the support rollers 52, 54 or 56.

The temperature of the transfuse belt 48 is preferably elevated using suitable heating devices well known in the xerographic arts. The transfuse belt may be heated either externally and/or internally at various locations about the extent of the belt. By internally, is meant that the heat source is positioned within the loop made by the belt 48 while externally means that the heat source is positioned outside of the loop created by the belt. The source of heat may be radiant or contact or a combination of both. By way of example, an external heat source depicted schematically by arrows 58 may be positioned adjacent the transfuse belt as shown in order to heat the belt prior to image transfer from the transfuse belt to the substrate 50. An internal heat source depicted schematically by arrows 60 may also be utilized depending on the requirements of the apparatus in which the transfusing arrangement of the present invention is utilized. An internal heat source (not shown) can alternatively be mounted inside 52, 54, and/or 56. Transfer of toner images from the ITB 28 to the transfuse belt 48 may be electrostatically assisted using a biased transfer roller 62.

A backup roller 64 is provided for creating a nip 66 with the support roller 54 through which the transfuse belt 48 passes. A force is applied to the backup roller 64 in a well known manner to thereby create pressure in the nip 66 to enable transfer of toner images from the transfuse belt 48 to a substrate 50 as the substrate passes through the nip 66. The support roller 54 may be electrically biased for assisting in the transfer of toner images to the substrate 50.

Once the composite toner images are transferred from the ITB 28 to the transfuse belt 48, residual toner particles and debris are removed from the ITB using a well known cleaning member 68 not forming a part of the present invention. Preferably, the cleaning structure comprises a blade cleaner but may also comprise one or more electrically biased brushes. Likewise, once the toner images have been transferred to the substrate 50, residual toner particles and debris are removed from the transfuse belt 48 using one or more sticky rollers 70 contacting the surface of the belt 48 downstream of the nip 66. A sticky roller is a system that has a sticky surface at an elevated temperature to which toner particles and debris readily adhere upon contact with such material surface.

The substrate 50 may be heated prior to its passage through the nip 66. To this end, there is provided a pair of heat and pressure rollers 72 and 74, one or both of which may be heated for elevating the temperature of the substrate 50. The paper is preferably preheated by the rollers 72 and 74 to a temperature for example, of about 80.degree. C. Preheating of the substrate 50 permits operation of the transfuse belt at a substantially lower transfusing temperature. For example, when the substrate 50 is preheated to a temperature of about 80.degree. C. the transfuse belt which in the absence of preheating would be elevated to a temperature of about 140 to 160 degree. C. would only have to be elevated to a temperature in the order of 100 to 120.degree. C. Of course, these temperatures will increase or decrease depending on the softening and melting characteristics of the toner. By reducing the required operating temperature of the transfuse belt, the life of the belt is thereby substantially extended.

Toner image gloss enhancement may be provided using a pair of heat and pressure rollers 76 and 78 that are similar in construction to a conventional roll fuser. Variable as well as operator selected print gloss may be provided according to prior art techniques and therefore does not form a part of the present invention.

The transfuse belt 48 may be fabricated using any suitable material such as silicone rubber. The belt thickness is preferably about 1 mm and has a circumferential extent of, for example, 20 inches. As will be appreciated, a transfuse belt having such a relatively large circumference provides for high speed transfusing as well as a convenient size for accommodating the various devices for implementing the transfuse feature.

While a release agent material is not required for satisfactory operation of the transfuse belt a Release Agent Management (RAM) system for applying a release agent material such as silicone oil may be utilized for applying silicone oil to the transfuse belt surface. A RAM system utilized for this purpose comprises a donor roll 80. For sake of clarity, the other components of RAM system have been omitted. By the application of about 0.1 milligrams of silicone oil per sheet of paper, the transfuse belt life may be appreciably extended.

Figure 2:
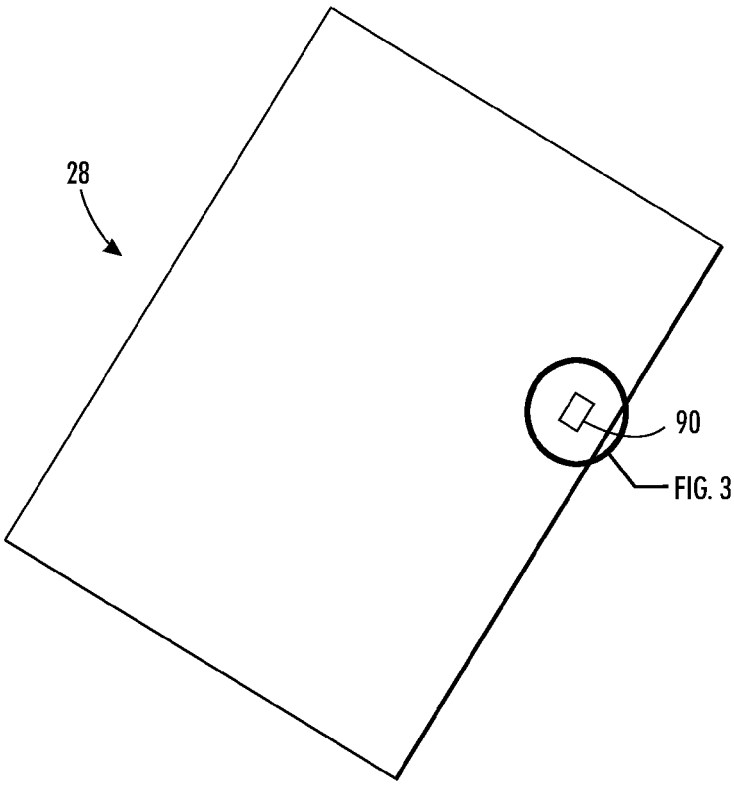
FIG. 2 is perspective view of a portion of an exemplary transfer belt in accordance with the disclosure.
Figure 3:
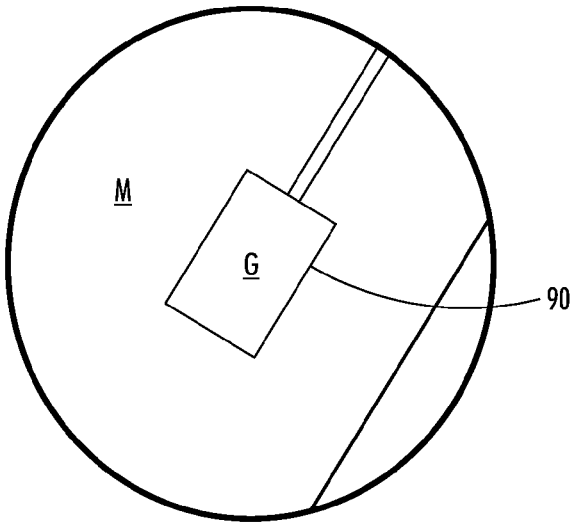
FIG. 3 is an enlarged portion of FIG. 4.

With additional reference to FIGS. 2 and 3, a portion of the ITB 28 including a cast-in timing patch 90 is illustrated. In the illustrated embodiment, the ITB 28 is made from a specially designed casting substrate having both a mirror finished region, corresponding to the size and location of the desired reflective timing patch, and a matte finished surface in all surrounding areas corresponding to the remainder of the belt surface. As a result, when the belt is cast on said substrate, the belt surface will be imparted with a reflective patch per the substrate design.

For example, a diamond turned casting drum having a mirrored finished can be used as the base stock. The desired timing patch area is then masked off. The entire drum is then mechanically abraded to dull the surface finish. Honing and numerous other methods work well in this process. The mask is then removed to reveal the cast-in timing patch region. The casting drum is then ready for use. The length of the patch can be chosen to meet a particular system's requirements and width of the patch can be varied from narrow to full belt width to reduce constraints and critical alignment in the belt slitting process. Belt slitting refers to cutting the belt to a specific width. Typically, a timing patch must be located within a certain specified location on the belt so that it travels within the timing sensor's detectable area. In the past, a timing sticker would need to be applied with precision 5 mm plus or minus 1 mm from the edge of a belt. Having a timing patch that runs the full width of the belt as set forth in the present disclosure eliminates this need for critical placement and the associated tolerance stack-up of prior art timing stickers. It should also be appreciated that using a traditional sticker or timing hole across the entire width of a belt is not possible due to interference with image transfer.

FIG. 3 is an enlarged portion of FIG. 2 illustrating the respective portions of the ITB 28 having a matte finish and a gloss or reflective finish. The matte finish portion of the ITB 28 comprises the majority of the ITB 28 and is identified generally by reference character M. The gloss or reflective portion of the surface of ITB 28 comprising the patch 90 is generally identified by reference character G. It will be appreciated that the region G is relatively more reflective than the region M thereby facilitating detection of the patch 90 by suitable reflectance based sensor or sensors. Thus, in some applications the area G comprising the patch 90 need only be reflective relative to the remainder of the ITB 28.

The ITB 28 can be fabricated from a polymer material such as polyimide, polycarbonate or the like. This belt may be fabricated in accordance with well-known manufacturing processes such as extruding, molding and casting. The belt thickness can be, for example, about 80 microns. The belt may be either seamless or seamed. In many applications a seamless structure is preferred. The ITB can be a single layer or a multiple layer structure.

The cast-in timing patch of the present disclosure can be detected using a variety of reflectance based sensors, much like the sensors used to detect prior art timing stickers. Accordingly, the transfer belt set forth in the present disclosure can be retrofitted to existing machines without needing to change the existing sensor or sensors of the retrofitted machine. In some retrofit applications, the sensor parameters can be adjusted to accommodate the cast-in belt timing patch of the present disclosure.

Figure 4:
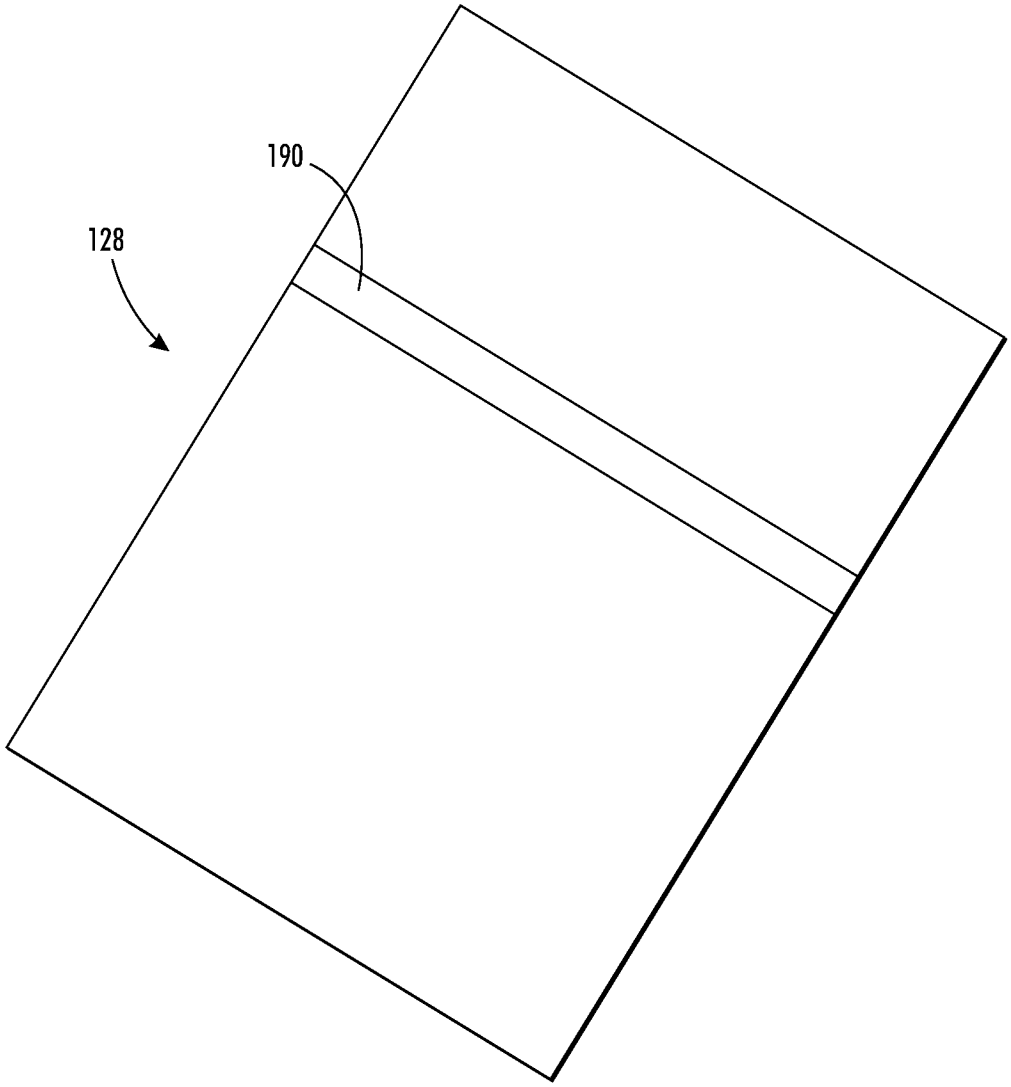
FIG. 4 is another exemplary transfer belt in accordance with the disclosure.

FIG. 4 is another exemplary ITB 128 having a reflective patch 190 that extends across the entire axial width of the ITB 128. That is, the patch 190 extends across the belt perpendicular to a direction of rotation of the ITB 128. It should be appreciated that other patch configurations are contemplated, and that the position of the patch on the ITB can be in virtually any desired location.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. An intermediate transfer belt onto which a toner image formed on a photosensitive body of an image-forming device is transferred comprising a cast-in belt timing patch, wherein the cast-in belt timing patch includes a surface of the intermediate transfer belt having a relatively high reflectance at least partially surrounded by a surface of the intermediate transfer belt having a relatively low reflectance.

2. An intermediate transfer belt as set forth in claim 1, wherein the surface of the intermediate transfer belt having a relatively high reflectance includes a gloss finish.

3. An intermediate transfer belt as set forth in claim 1, wherein the surface of the intermediate transfer belt having a relatively low reflectance includes a matte finish.

4. An intermediate transfer belt as set forth in claim 1, wherein the belt is composed of a cast material, and wherein the cast-in timing patch is formed integrally with and comprised of the cast material.

5. An intermediate transfer belt as set forth in claim 1, wherein the belt is composed of an extruded material, and wherein the cast-in timing patch is formed integrally with and comprised of the extruded material.

6. An intermediate transfer belt as set forth in claim 1, wherein the belt is composed of a molded material, and wherein the cast-in timing patch is formed integrally with and comprised of the molded material.

7. An intermediate transfer belt as set forth in claim 1, wherein the cast-in belt timing patch extends across an axial width of the belt perpendicular to a direction of rotation of the belt.

8. An intermediate transfer belt as set forth in claim 7, wherein the cast-in belt timing patch extends between transverse edges of the belt.

9. A printer comprising at least one xerographic imaging engine for creating a tonor image, and an intermediate transfer belt as set forth in claim 1.

* * * * *